United States Patent [19]

Masologites et al.

[11] 4,448,584

[45] May 15, 1984

[54] PROCESS FOR REMOVING SULFUR FROM COAL

[75] Inventors: George P. Masologites, Columbus, N.C.; Jui-Yuan Sun, South Holland, Ill.; Jin S. Yoo, Flossmoor, Ill.; Emmett H. Burk, Jr., Glenwood, Ill.

[73] Assignee: Atlantic Richfield Company, Philadelphia, Pa.

[21] Appl. No.: 175,983

[22] Filed: Aug. 7, 1980

Related U.S. Application Data

[63] Continuation of Ser. No. 944,435, Sep. 21, 1980, abandoned.

[51] Int. Cl.[3] ..... C10L 9/02

[52] U.S. Cl. ..... 44/1 SR

[58] Field of Search ..... 44/1 SR, 24, 1 A; 201/17; 75/3

[56] References Cited

U.S. PATENT DOCUMENTS

| | | | |
|---|---|---|---|
| 3,756,791 | 9/1973 | Mancke | 44/1 SR |
| 4,092,125 | 5/1978 | Stambaugh et al. | 44/1 SR |
| 4,155,716 | 5/1979 | Sun et al. | 44/1 SR |

*Primary Examiner*—Carl F. Dees

*Attorney, Agent, or Firm*—John B. Goodman

[57] ABSTRACT

A process for reducing the sulfur and ash content of coal comprising the steps of:

(1) contacting coal particles containing ash and iron pyrite mineral matter with a promoting amount of at least one conditioning agent capable of modifying or altering the existing surface characteristics of the pyrite under conditions to effectuate alteration or modification of at least a portion of the contained pyritic sulfur;

(2) separating the coal particles from at least a portion of the pyritic sulfur while surface characteristics are altered or modified; and (3) recovering coal particles wherein the coal exhibits reduced sulfur and ash content.

17 Claims, No Drawings

PROCESS FOR REMOVING SULFUR FROM COAL

This is continuation of application Ser. No. 944,435, filed Sept. 21, 1978 and now abandoned.

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes chemically associated with the coal structure itself. Depending on the particular coal, the sulfur content can be primarily in the form of either inorganic sulfur or organic sulfur. Distribution between the two forms varies widely among various coals. For example, both Appalachian and Eastern interior coals are known to be rich in pyritic and organic sulfur. Generally, the pyritic sulfur represents from about 25% to 70% of the total sulfur content in these coals.

Heretofore, it was recognized that it would be highly desirable to remove (or at least lower) the sulfur content of coal prior to combustion. In this regard, a number of processes have been suggested for reducing the inorganic (pyritic) portion of the sulfur in coal.

For example, it is known that at least some pyritic sulfur can be physically removed from coal by grinding the coal, and subjecting the ground coal to froth flotation or washing processes. While such processes can desirably remove some pyritic sulfur and ash from the coal, these processes are not fully satisfactory because a significant portion of the pyritic sulfur is not removed. Attempts to increase the portion of pyritic sulfur removed have not been successful because these processes are not sufficiently selective. Because the process is not sufficiently selective, attempts to increase pyrite removal can result in a large portion of coal being discarded along with ash and pyrite. Organic sulfur cannot be physically removed from coal.

There have also been suggestions heretofore to chemically remove pyritic sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process:

$$2FeCl_3+FeS_2\rightarrow 3FeCl_2+S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently represent a second discrete process step with its attendant problems and cost which must be employed to remove the sulfur from coal. In addition, this process is notably deficient in that it cannot remove organic sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2+H_2O+7/2O_2\rightarrow FeSO_4+H_2SO_4$$

$$2FeSO_4+H_2SO_4+1/2O_2\rightarrow Fe_2(SO_4)_3+H_2O$$

These reaction equations indicate that in this particular process the pyritic sulfur content continues to be associated with the iron as sulfate. Several factors detract from the desirability of this process. High temperatures and pressures are employed which can necessitate the use of expensive reaction vessels and processing plants of complex mechanical design. Because high temperatures are employed, excessive amounts of energy can be expended in the process. In addition, the above oxidation process is not highly selective such that considerable amounts of coal itself can be oxidized. This is undesirable, of course, since the amount and/or heating value of the coal recovered from the process is decreased.

Heretofore, it was known that coal particles could be agglomerated with hydrocarbon oils. For example, U.S. Pat. No. 3,856,668 to Shubert issued Dec. 24, 1974, and U.S. Pat. No. 3,665,066 to Capes et al issued May 25, 1972 disclose processes for recovering coal fines by agglomerating the fine coal particles with oil. U.S. Pat. No. 3,268,071 to Puddington et al issued Aug. 23, 1966 and U.S. Pat. No. 4,033,729 issued July 5, 1977 to Capes disclose processes involving agglomerating coal particles with oil in order to provide a separation of coal from ash. While these processes can provide some benefication of coal, improved ash and iron pyrite mineral matter removals would be desirable.

The above U.S. Pat. No. 4,033,729 to Capes et al relating to removing inorganic materials (ash) from coal significantly notes that iron pyrite mineral matter has proven difficual to remove because of its possible hydrophobic character. This disclosure confirms a long standing problem. The article "The Use of Oil in Cleaning Coal" Chemical and Metallurgical Engineering, Vol. 25, pages 182–188 (1921) discusses in detail cleaning coal by separating ash from coal in a process involving agitating coal-oil-water mixtures, but notes that iron pyrite is not readily removed in such a process.

In summary, while there is much prior art relating to processes for removing sulfur and ash from coal, there still exists a present need for a simple, efficient process for removing sulfur and ash from coal.

SUMMARY OF THE INVENTION

This invention provides a practical method for more effectively reducing the sulfur and ash content of coal. In summary, this invention involves a process for reducing the sulfur and ash content of coal comprising the steps of:

(1) contacting coal particles containing ash and iron pyrite mineral matter with a promoting amount of at least one conditioning agent capable of modifying or altering the existing surface characteristics of the pyrite under conditions to effectuate alteration or modification of at least a portion of the contained pyritic sulfur;

(2) separating the coal particles from at least a portion of the pyritic sulfur while surface characteristics are altered or modified; and (3) recovering coal particles wherein the coal exhibits reduced sulfur and ash content.

It has been discovered that contacting sulfur-containing coal with the conditioning agents of this invention renders the pyrite more amenable to separation from the coal particles on agglomerating the coal particles with hydrocarbon oil. In addition, ash and total sulfur, including non-pyritic sulfur, removals can be enhanced by employing the conditioning agent in conjunction with agglomerating the coal particles with oil.

A notable advantage of the process is that significant sulfur reduction is obtained without significant loss of the coal substrate. The desirable result is that sulfur reduction is obtained without the amount and/or heating value of the coal being significantly decreased. Another advantage is that ambient conditions (i.e., normal temperatures and atmospheric pressure) can be employed such that process equipment and design is simplified, and less energy is required. Another advantage is that solid waste disposal problems can be reduced.

DETAILED DESCRIPTION OF THE INVENTION AND ITS PREFERRED EMBODIMENTS

In its broad aspect, this invention provides a method for reducing the sulfur content of coal by a process comprising the steps of:

(1) contacting coal particles containing ash and iron pyrite mineral matter with a promoting amount of at least one conditioning agent capable of modifying or altering the existing surface characteristics of the pyrite under conditions to effectuate alteration or modification of at least a portion of the contained pyritic sulfur;

(2) separating the coal particles from at least a portion of the pyritic sulfur while surface characteristics are altered or modified; and (3) recovering coal particles wherein the coal exhibits reduced sulfur and ash content.

The novel process of this invention can substantially reduce the pyritic sulfur content of coal without substantial loss of the amount and/or heating value of the coal. In addition, the process by-products do not present substantial disposal problems.

Suitable coals which can be employed in the process of this invention include brown coal, lignite, subbituminous, bituminous (high volatile, medium volatile, and low volatile), semi-anthracite, and anthracite. The rank of the feed coal, can vary and provide for pyritic sulfur removal by the process of this invention, although bituminous coals and higher ranked coals are preferred. Metallurgical coals, and coals which can be processed to metallurgical coals, containing sulfur in too high a content, can be particularly benefited by the process of this invention. In addition, coal refuse from wash plants which have been used to upgrade run-of-mine coal can also be used as a source of coal. Typically, the coal content of a refuse coal will be from about 25 to about 60% by weight of coal. Particularly preferred refuse coals are refuse from the washing of metallurgical coals.

In the process of this invention, coal particles containing iron pyrite mineral matter are contacted with a promoting amount of conditioning agent which can modify or alter the surface characteristics of these existing pyrite minerals such that pyrite becomes more amenable to separation from the coal upon agglomeration when compared to the pyritic minerals prior to conditioning.

It is an important aspect of this invention that the separation of the coal particles be effectuated during the time that the surface characteristics of the pyrite are altered or modified. This is particularly true when the conditions of contacting and/or chemical compounds present in the aqueous medium can cause realteration or remodification of the surface such as to deleteriously diminish the surface differences between pyrite mineral matter and the coal particles.

Conditioning agents useful herein include inorganic compounds which can hydrolyze in water, preferably under the conditions of use, and the hydrolyzed forms of such inorganic compounds, preferably, such forms which exist in effective amounts under the condition of use. Proper pH and temperature are necessary for some inorganic compounds to exist in hydrolyzed form. When this is the case, such proper conditions are employed. The inorganic compounds which are hydrolyzed or exist in hydrolyzed form under the given conditions of contacting (e.g., temperature and pH) can modify or alter the existing surface characteristics of the pyrite. Preferred inorganic compounds are those which hydrolyze to form high surface area inorganic gels in water, such as from about 5 square meters per gram to about 1000 square meters per gram.

Examples of such conditioning agents are the following:

I. Metal Oxides and Hydroxides having the formula: $M_aO_b.xH_2O$ and $M(OH).xH_2O$, wherein M is Al, Fe, Co, Ni, Zn, Ti, Cr, Mn, Mg, Pb, Ca, Ba, In or Sb; a, b and c are whole numbers depending on the ionic valence of M, and x is from 0 to about 3.

Preferably M is a metal selected from the group consisting of Al, Fe, Mg, Ca and Ba. These metal oxides and hydroxides are known materials. Particularly preferred are aluminum hydroxide gels in water at pH 7 to 7.5. Such compounds can be readily formed by mixing aqueous solutions of water soluble aluminum compounds, for example, aluminum nitrate or aluminum acetate, with suitable hydroxides, for example, ammonium hydroxide. In addition, a suitable conditioning agent is formed by hydrolyzing bauxite ($Al_2O_3.xH_2O$) in alkaline medium to an alumina gel. Calcium hydroxide represents another preferred conditioning agent. Calcined calcium and magnesium oxides are also preferred conditioning agents. Mixtures of such compounds can very suitably be employed. The compounds are preferably suitably hydrolyzed prior to contacting with coal particles in accordance with the invention.

II. Metal aluminates having the formula:

$M'_d(AlO_3)_e$ or $M'_f(AlO_2)_g$, wherein M' is Fe, Co, Ca, Mg, Ba, Ni, Pb or Mo; and d, e, f, and g are whole numbers depending on the ionic valence of M.

Compounds wherein M' is Ca or Mg, i.e., calcium aluminates and magnesium aluminates are preferred. These preferred compounds can be readily formed by mixing aqueous solutions of water soluble calcium and magnesium compounds, for example, calcium or magnesium acetate with sodium aluminate. Mixtures of metal aluminates can very suitably be employed. The compounds are most suitably hydrolyzed prior to contacting with coal particles in accordance with the invention.

III. Aluminasilicates having the formula:

$Al_2O_3.x\ SiO_2$ wherein x is from about 0.5 to 5.

A preferred aluminasilicate conditioning agent for use herein has the formula $Al_2O_3.4SiO_2$. Suitably aluminasilicates for use herein can be formed by mixing together in aqueous solution a water soluble aluminum compound, for example, aluminum acetate, and a suitable alkali metal silicate, for example, sodium metasilicate, preferably, in suitable stoichiometric amounts to provide preferred compounds set forth above.

IV. Metal silicates wherein the metal is calcium, magnesium, tin, barium or iron.

Metal silicates can be complex mixtures of compounds containing one or more of the above mentioned metals. Such mixtures can be quite suitable for use as conditioning agents.

Calcium and magnesium silicates are among the preferred conditioning agents of this invention.

These conditioning agents can be prepared by mixing appropriate water soluble metal materials and alkali metal silicates together in an aqueous medium. For example, calcium and magnesium silicates, which are among the preferred conditioning agents, can be prepared by adding a water soluble calcium and/or magnesium salt to an aqueous solution or dispersion of alkali metal silicate.

Suitable alkali metal silicates which can be used for forming the preferred conditioning agents are potassium silicates and sodium silicates. Alkali metal silicates for forming preferred calcium and magnesium conditioning agents for use herein are compounds having $SiO_2$:$M_2O$ formula weight ratios up to 4:1, wherein M represents an alkali metal, for example, K or Na.

Alkali metal silicate products having silica-to alkali weight ratios ($SiO_2$:$M_2O$) up to about 2 are water soluble, whereas those in which the ratio is above about 2.5 exhibit less water solubility, but can be dissolved by steam under pressure to provide viscous aqueous solutions or dispersions.

The alkali metal silicates for forming preferred conditioning agents are the readily available potassium and sodium slicates having an $SiO_2$:$M_2O$ formula weight ratios up to 2:1. Examples of specific alkali metal silicates are anhydrous $Na_2SiO_3$ (sodium metasilicate), $Na_2Si_2O_5$ (sodium disilicate), $Na_4SiO_4$ (sodium orthosilicate), $Na_6Si_2O_7$ (sodium pyrosilicate) and hydrates, for example, $Na_2SiO_3.nH_2O$ (n=5, 6,8 and 9), $Na_2Si_4O_9.7H_2O$ and $Na_3HSiO_4.5H_2O$. Examples of suitable water soluble calcium and magnesium salts are calcium nitrate, calcium hydroxide and magnesium nitrate. The calcium and magnesium salts when mixed with alkali metal silicates described hereinbefore form very suitable conditioning agents for use herein.

Calcium silicates which hydrolyze to form tobermorite gels are especially preferred conditioning agents for use in the process of the invention.

V. Inorganic Cement Materials.

Inorganic cement materials are among the preferred conditioning agents of the invention. As used herein, cement material means an inorganic substance capable of developing adhesive and cohesive properties such that the material can become attached to mineral matter. Cement materials can be discrete chemical compounds, but most often are complex mixtures of compounds. The most preferred cements (and fortunately, the most readily available cements) are those cements capable of being hydrolyzed under ambient conditions which are the preferred conditions of contacting with the coal in the process.

These preferred cement materials are inorganic materials which when mixed with a ratio of water to form a paste can set and harden. Cement and materials used to form cements are discussed in Kirk-Othmer, Encyclopedia of Chemical Technology, 2D. Ed., Vol. 4 c. 1964 by John Wiley & Sons, Inc., pages 684 to 710 being incorporated by reference herein. Examples of cement materials include calcium silicates, calcium aluminates, calcined limestone and gypsum. Especially preferred examples of cement materials are the materials employed in hydraulic limes, natural cement, masonry cement, pozzolan cement and portland cement. Such materials will often include magnesium cations in addition to calcium.

Commercial cement materials, which are very suitable for use herein, are generally formed by sintering calcium carbonate (as limestone), or calcium carbonate (as limestone) with aluminum silicates (as clay or shale). Preferably, such materials are hydrolyzed prior to use as conditioning agents.

With some coals, the material matter associated with the coal may be such that on treatment under proper conditions of temperature and pH the mineral matter can be modified in situ to provide the suitable hydrolyzed inorganic conditioning agents for carrying out the process. In such cases, additional conditioning agents may or may not be required depending on whether an effective amount of conditioning agent is generated in situ.

The conditioning agents suitable for use herein can be employed alone or in combination.

The coal particles employed in this invention can be provided by a variety of known processes, for example, grinding or crushing.

The particle size of the coal can vary over wide ranges. In general, the particles should be of a size to promote the removal of pyritic sulfur upon contacting with the conditioning agent in the aqueous medium. For instance, the coal may have an average particle size of one-eighth inch in diameter or in some instances, as small as minus 200 mesh (Tyler Screen) or smaller. Depending on the occurrence and mode of distribution of pyritic sulfur in the coal, the rate of sulfur removal will vary. In general, if the pyrite particle size is relatively large in its occurrence, and is liberated readily upon grinding, sulfur removal rates will be faster with accompanying substantial sulfur removals. If the pyrite size is small and associated with the coal through surface contact or encapsulation, the degree of grinding will have to be increased in order to provide for liberation of the pyrite particles. In a preferred embodiment of this invention, the coal particles are reduced in size sufficient to effectuate liberation and effeciency of conditioning. A very suitable particle size is often minus 24 mesh, for example minus 24 mesh on 200 mesh, preferably minus 50 mesh on 100 mesh as less effort is required for grinding and handling and yet the particles are sufficiently small to achieve an effective degree of sulfur removal.

The coal particles are preferably contacted with the conditioning agent in an aqueous medium by forming a mixture of the coal particles, conditioning agent and water. The mixture can be formed, for example, by grinding coal in the presence of water and adding a suitable amount of conditioning agent. Another very suitable contacting method involves forming an aqueous mix of conditioning agent, water and coal and then crushing the coal with the aqueous mix of conditioning agent, for example, in a ball mill, to particles of a suitable size. Preferably, the aqueous medium contains from about 5% to about 55%, more preferably from about 20% to about 40%, by weight of the aqueous medium, of coal particles.

The coal particles are contacted for a period of time and under conditions of temperature and pressure sufficient to modify or alter the existing surface characteristics of the pyritic mineral matter sulfur in the coal such that it becomes more amenable to separation from the coal. The optimum time will depend upon the particular reaction conditions and the particular coal employed. Generally, a time period in the range of from about 1 minute to 2 hours or more, can be satisfactorily employed. Preferably, a time period of from 10 minutes to 1 hour is employed. During this time, agitation can be desirably employed to enhance contacting. Known mechanical mixers, for example, can be employed.

An amount of conditioning agent is employed which promotes the separation of pyrite from coal. Generally, from about 0.01% to 15%, preferably from about 0.5% to 5, by weight of coal, of conditioning agent is employed.

Preferably the amount of conditioning agent is based on the ash content of the coal. From about 0.05% to 30%, preferably 0.05% to 10%, and most preferably from about 1% to 10%, by weight, ash is employed.

A variety of conventional techniques employed heretofore for separating coal and mineral matter can be employed for separating coal and mineral matter including ash and pyrite in this invention. (While such techniques may provide some pyrite removal without conditioning, treatment with a conditioning agent in accordance with this invention gives improved pyrite removal.)

Examples of such conventional separation techniques which can be employed are dense media separation, froth flotation and oil agglomeration.

Dense media separation involves separating a mixture of coal and mineral matter by placing the mixture in a medium in which coal floats and the mineral matter sinks. Treatment of coal particles with conditioning agent in accordance with this invention improves pyrite separation from the coal particles.

Froth flotation is a process for separating fine-size coal particles and mineral matter by foaming an aqueous slurry of the coal. Selective attachement of air bubbles to the coal particles causes them to be buoyed up into the froth while the mineral particles remain in the under flow. Froth containing the coal particles is readily separated, for example, by skimming. Conventional foaming and skimming techniques can be employed. Treatment of the coal in accordance with the invention, improves the separation of pyrite from the coal particles.

Oil agglomeration is a preferred separation technique. In oil agglomeration, coal particles are agglomerated with oil to form coal-oil agglomerates, and An amount of hydrocarbon oil necessary to form coal hydrocarbon oil agglomerates can be present during this conditioning step. Alternatively, and preferably, after the coal particles have been contacted with the conditioning agent in aqueous solution for a sufficient time, the coal particles are agglomerated with hydrocarbon oil.

Coal-oil agglomerates are readily formed by agitating a mixture of water, hydrocarbon oil and coal particles. In the process of this invention, it is preferred to add the hydrocarbon oil to the aqueous medium of coal particles and conditioning agent, and agitate the resulting mixture to agglomerate the coal particles. If necessary, the water content of the mixture can be adjusted to provide for optimum agglomerating. Generally from about 30 to 95 parts water, and more preferably 40 to 90 parts water, based on the weight of coal, is most suitable for agglomeration. There should be sufficient hydrocarbon oil present to agglomerate the coal particles. The optimum amount of hydrocarbon oil will depend upon the particular hydrocarbon oil employed, the size and rank of the coal particles. Generally, the amount of hydrocarbon oil will be from about 1% to 60%, preferably 2% to 30%, by weight, of coal. Most preferably the amount of hydrocarbon oil will be from about 2% to 15%, by weight, of coal. As stated above, it is in important part of this invention that the agglomeration and separation of the coal particles be effectuated before realteration or remodification of the iron pyrite mineral matter.

Suitable hydrocarbon oils for forming the coal-oil agglomerates are derived from petroleum, shale oil, tar sand and coal. Especially suitable hydrocarbon oils are light and heavy refined petroleum fractions such as light cycle, heavy cycle oil, heavy gas oil, clarified oil, kerosene, heavy vacuum gas oil, residual oils, coal tar and other coal derived oils. Mixtures of various hydrocarbon oils can be quite suitable; particularly when one of the materials is very viscous.

When it is desirable to utilize heavy oils and/or to reduce the overall amount of oil used in the agglomeration step light hydrocarbons such as butane, pentane and/or hexane can be added alone or to heavier hydrocarbon oil during the agglomeration step. After separation of the coal particles from the mineral matter and pyritic sulfur, the lighter hydrocarbon can be stripped out by conventional means and recycled to the agglomeration step. If it is desired to form a hard coal product, e.g., a pellet, a binder, e.g., asphalt, may be added to the recovered coal particles to obtain such a product using conventional pelletizing equipment.

The hydrocarbon oils employed in this invention are hydrophobic and will preferentially wet hydrophobic material. It was recognized in this regard heretofore, that coal and the existing pyritic sulfur mineral matter can have similar surface characteristics which make separation of pyrite from coal difficult. While not wishing to be bound by any particular theory, it is theorized that the conditioning agents can alter or modify the pyrite by associating with the pyrite or alter the existing pyrite surface physically or chemically to impart to the modified or altered pyrite surface more mineral-like surface characteristics. The chemical or physical altering of the surface can include the removal of su face constituents or impurities, thereby providing for separation of the pyrite from the coal upon agglomeration.

Since these altered or modified pyrite mineral surface characteristics differ from the surface characteristics of the coal particles, advantage can be taken of the differing surface characteristics at the time of agglomeration to separate the conditioned pyrite and coal.

Whatever the exact mechanism may be, it has been discovered that treating coal particles with a conditioning agent in accordance with this invention alters or modifies the surface characteristics of iron pyrite mineral matter. The result is that when the mixture of water, hydrocarbon oil and coal particles is agitated, the hydrocarbon oil preferentially wets (becomes associated with) the coal particles, as opposed to the altered iron pyrite and ash. These hydrocarbon wet coal particles will collide with one another under suitable agitation forming coal-oil agglomerates substantially reduced in pyrite and ash. In general, the size of the coal-oil agglomerate is generally at least about 2 to 3 times the average size of the coal particles which make up the coal-oil agglomerates. Increasing amounts of oil can provide a substantial increase in agglomerate size.

As used herein "coal agglomerate" means an aggregate of a plurality of coal particles. These coal agglomerates can have a wide range of particle sizes. For example, agglomerates include small aggregates or flocs formed of several coal particles such that the aggregate is about 2 times, preferably from about 3 to 10 times, the average size of the coal particles which make up the agglomerate. (Such small agglomerates can be referred to as flocs or aggregates and are included within the term agglomerate. Agglomerates can also include a large plurality of particles such that the agglomerate size is quite large. For example, agglomerates in the shape of balls having diameters of from about ⅛ inch to 1 inch, or larger can be formed.

Agitating the mixture of water, hydrocarbon oil and coal particles to form coal-oil agglomerates can be suitably accomplished using stirred tanks, ball mills or other apparatus.

The resulting coal-oil agglomerates can be separated from ash and pyrite using a variety of separation techniques.

Preferably a separation is effected by taking advantage of the size difference between coal-oil agglomerates and unagglomerated mineral matter. For example, the coal-oil agglomerates can be separated from the water and liberated ash and pyrite, etc., by filtering with bar sieves or screens, which predominantly retain the coal-oil agglomerates, but pass water and unagglomerated mineral matter. When this technique is employed, coal-oil agglomerates of a size suitable for ready filtering must be formed.

Often it is desired to use small amounts of oil to form coal-oil agglomerates. Small amounts of oil, however, may provide small coal-oil agglomerates. Small coal-oil agglomerates (aggregates and flocs) can be more desirably separated by taking advantage of the different surface characteristics of the coal-oil agglomerates, and ash and conditioned pyrite, for example, employing well known froth flotation and/or scimming techniques.

Some ash or pyrite might have become occluded or associated with the coal-oil agglomerates. For this reason, it is often preferable to wash the recovered coal-oil agglomerates with water, depending on the effectiveness of this step, re-slurry them in water, and subjecting them to additional agitation. The result is that the recovered coal-oil agglomerates can break, liberating additional ash and pyrite, and reagglomerate. Employing this technique, additional reductions of ash and pyrite can be obtained. With some coals this can be preferred.

Ball milling, rod milling or the equivalent thereof can be particularly effective since these agitation methods provide a kneading action which can continually break and change the surface of the coal-oil agglomerate exposing and liberating additional ash and pyrite materials from the conditioned coal. These methods are particularly useful when forming coal-oil agglomerates of high oil content, for example, from about 25% to about 50% oil, by weight of the coal-oil agglomerate.

The coal-oil agglomerates can be recovered using the separation techniques mentioned hereinbefore.

The coal-oil agglomerates provided by the process of the invention are coal-oil agglomerates wherein the coal portion is reduced in sulfur content. The weight percent of iron pyrite in the coal portion is reduced at least by 50%, and often 70% to 90% or more, for example 99%. The coal-oil agglomerates are themselves an excellent low sulfur, reduced ash fuel and can be used as such.

If desired the oil can be removed from these coal-oil agglomerates to provide coal particles reduced in ash and sulfur content. A variety of methods can be employed to remove the hydrocarbon oil from the coal-oil agglomerates. For example, agglomerates can be washed with an organic solvent, for example, hexane or toluene, in which the hydrocarbon oil is soluble, and separating the resulting solution from the coal particles.

The resulting coal product has a substantially reduced pyritic sulfur content and can exhibit a diminished non-pyritic sulfur content, for example, in some coals up to 30%, by weight of non-pyritic sulfur (i.e., sulfate, sulfur and/or organic sulfur) is removed. In addition, the coal product can be reduced in ash. The coal can be dried prior to use or storage.

In the process of this invention, ash and pyrite are rejected to the aqueous phase. This aqueous phase containing rejected ash and pyrite is a by-product of the process. Typically, disposal of ash and pyrite by-products presents substantial environmental problems. It is known that pyrite oxidizes readily in the presence of water to form sulfuric acid. It is also known that fine ash particles are difficult to separate from water. In addition, physical coal cleaning processes generate unrecovered coal fines which create additional disposal problems.

An important aspect of this invention is the discovery that the conditioning agents employed herein modify both the ash and pyrite such that the pyrite may be less susceptible to oxidation and the ash and pyrite to separate from water more quickly. The result is that disposal problems associated with these materials are substantially reduced, i.e., ease of dewatering in the case of separation. In addition, since substantially all, i.e., more than 90% by weight, of the organic coal treated in the process of this invention can be recovered, unrecovered coal (i.e. coal fines) do not present a disposal problem, such as spontaneous combustion which can occur in refuse piles.

It is another aspect of this invention that coal recovered from the process exhibits substantially improved fouling and slagging properties. Thus, the process can provide for improved removals of those inorganic constituents which cause high flouling and slagging in combustion furnaces.

The following examples are provided to better illustrate the invention by presenting several specific embodiments of the process of the invention.

EXAMPLE I

Upper Freeport, Kingwood Mine coal was ground and screened to provide a quantity of feed coal having a particle size of less than 80 mesh. This coal was divided to provide several coal portions. Four coal portions were treated as described below.

PART I (Comparative)

A 10 gram portion of the coal was slurried in a beaker with 500 ml. of water at room temperature and stirred with a high speed stirrer for 15 minutes. With continued stirring, 12%, by weight of coal, of hydrodesulfurized light cycle oil was slowly added to the coal water mixture. When the light cycle oil was added, the coal particles began to agglomerate, forming coal-oil agglomerates. Stirring was continued until agglomeration was essentially complete. The contents of the beaker were then poured onto a 40 mesh screen to recover the coal-oil agglomerates. The coal-oil agglomerates were washed with water. These coal-oil agglomerates were de-oiled by washing the coal-oil agglomerates with an organic solvent (iso-propanol) to remove the hydro-carbon oil and recover a coal product of slightly reduced sulfur and ash content.

The process set forth in Part I is not an example of the invention, but is presented for comparison with the process of the invention.

PART II (Invention)

A 10 gram portion of the coal was treated as set forth in Part I above except that calcium acetate and sodium metasilicate were added to the slurry of coal and water before stirring commenced to form calcium silicate (a preferred conditioning agent) in situ. The quantities of calcium acetate and sodium metasilicate added were such that the ratio of calcium to silicate was 1:1 and the quantity of calcium silicate was 5.8% by weight of coal.

The process set forth in Part II is an example of the process of the invention. As will be noted in Table I below, pyrite eye is substantially reduced and improved ash removal is obtained.

PART III (Invention)

A 16 gram portion of the coal, 500 ml. water and a quantity of calcium acetate and sodium metasilicate to provide a percent quantity of calcium silicate conditioning agent as set forth in Part II were added to a half-gallon ball mill having ¼ inch stainless steel balls. The contents were then ball milled for three hours. The action of the ball mill further pulverized the coal particles to smaller particle size.

The mixture was then emptied into a beaker. As in Parts I and II above, the mixture was stirred with a high speed stirrer as hydrodesulfurized light cycle oil was added to form coal-oil agglomerates. Because ball milling reduced the particle size of the coal, more oil (23% by weight of coal) was required to form desired size coal-oil agglomerates.

After the coal-oil agglomerates were formed, they were recovered and treated as in Part II above.

It will be noted in Table I below that this procedure provides even better pyritic sulfur and ash removal.

PART IV (Invention)

A 16 gram portion of the coal was treated as in Part III, except the oil agglomeration was performed using the ball mill. In this procedure, after the three hour ball milling with calcium silicate, the ball mill was stopped from time to time to add a quantity of hydrodesulfurized light cycle oil. This process was continued until good agglomerates were obtained. This procedure required 65%, by weight of coal, of oil because additional further reduced coal particle size.

While more oil was required, it will be noted in Table I below that this procedure provides outstanding pyritic sulfur and ash removal.

As will be noted in Table I below, percent carbon recovery in the process of the invention is excellent. This is indicative of the surprisingly good coal recovery provided by the process.

TABLE I

| PART | COAL | % Total Sulfur | % Pyritic Sulfur | % Ash | % Removal Total S | % Removal Pyrite | % Removal Ash | % Carbon Recovery |
|---|---|---|---|---|---|---|---|---|
| | Kingwood Feed Coal, 80 mesh | 3.11 | 1.93 | 12.4 | | | | |
| I | High Speed Agglomeration, 12% Oil | 2.39 | 1.68 | 10.6 | 23 | 13 | 15 | |
| II | Calcium Silicate Conditioning | 1.71 | 0.65 | 8.29 | 45 | 66 | 33 | 94 |
| III | High Speed Agglomeration, 12% Oil Calcium Silicate Conditioning Wet Grinding (Ball Milling) | 1.44 | 0.52 | 6.21 | 54 | 73 | 50 | 96 |
| IV | High Speed Agglomeration, 25% Oil Calcium Silicate Conditioning Wet Grinding (Ball Milling) Ball Mill Agglomeration, 65% Oil | 0.82 | 0.13 | 2.43 | 74 | 93 | 80 | 99 |

EXAMPLE II

Upper Freeport, Kingwood Mine coal was ground and screened to provide a quantity of feed coal of less than 80 mesh.

Portland cement (Type I) was hydrolyzed in water by mixing the cement and water, and allowing the mixture to stand for a few days. (Sufficient water was present such that the cement did not set to form concrete, but rather remained as a gel.) This hydrolyzed Portland cement was used as the conditioning agent employed in this example.

Twenty grams coal, 1 gram hydrated Portland cement and 350 ml. water were added to a half-gallon ball mill having ¼ inch stainless steel balls. The contents were then ball milled for three hours. At the end of the three-hour period, quantities of hydrodesulfurized light cycle oil were added to the ball mill from time to time, and ball milling was continued until the coal was agglomerated. Because the ball milling reduced the size of the coal particles, 42%, by weight of coal, of oil was required to agglomerate the coal.

The contents of the ball mill were then emptied onto a screen to separate and recover the coal-oil agglomerates. The coal-oil agglomerates were washed with water.

These coal-oil agglomerates were de-oiled by washing the coal-oil agglomerates with a hydrocarbon oil solvent (toluene and hexane) to remove the hydrocarbon oil and recover a coal product of reduced pyritic sulfur and ash content. It is notable that this product is also reduced in organic sulfur content.

The sulfur and ash content of the feed coal and the sulfur and ash content of the coal after treatment are presented in Table II below on a dry ash-free basis.

TABLE II

| Coal | % Total Sulfur (Dry Basis) | % Pyrite Sulfur | % Sulfate Sulfur (Dry Basis) | % Organic Sulfur | % Ash |
|---|---|---|---|---|---|
| Kingwood Feed Coal | 3.11 | 1.93 | 0.25 | 0.93 | 12.4 |
| Example II Treated Coal | 0.83 | 0.21 | 0.04 | 0.57 | 5.55 |
| | (73% Removal) | (89% Removal) | | (39% Removal) | (55% Removal) |

EXAMPLE III

When in Example II, aluminum nitrate and sodium silicate were added in an amount to provide 1.5%, by weight of coal, of a reaction product comprising silica alumina gel, a conditioning agent, instead of hydrolyzed Portland cement, the same or similar results are obtained in that a coal product substantially reduced in sulfur and ash is obtained.

EXAMPLE IV

A coal sample was crushed in a ball mill and screened to provide coal particles having a particle size of less than 200 mesh. These coal particles were divided into several equal portions to provide feed coal for treatment in accordance with the invention.

Each sample was slurried in water containing 1%, by weight of coal, of conditioning agent. The slurry was allowed to stand for 15 minutes at room temperature. The slurry was then stirred with a high speed stirrer. With continued stirring, about 30%, by weight of coal, hydrodesulfurized light cycle oil was slowly added to the slurry. When the light cycle oil was added, the coal particles began forming coal-oil agglomerates. The contents of the beaker were then poured onto a 40-mesh screen to recover the coal-oil agglomerates. The coal-oil agglomerates were washed with water. They were then re-slurried in water and subjected to additional stirring (shearing agitation) which broke and re-agglomerated the agglomerates. This was continued for 5 minutes. The agglomerates were again separated by a screening, washed with water, again reslurried with water as above and the procedure was repeated. After the procedure was again repeated, the coal-oil agglomerates were separated by screening.

The agglomerates were then introduced into a ½ gallon ball mill containing ½ inch porcelain balls and 300 ml. water and ball milled for two hours.

The agglomerates were separated from the water and de-oiled by washing the coal-oil agglomerates with isopropanol to remove the light cycle oil.

The conditioning agents employed, the sulfur ash content of the feed and the sulfur and ash content of coal after treatment are presented in Table III below.

The sulfur and ash contents are on a dry ash-free basis.

TABLE III

| Conditioning Agent | % Ash | Total % Sulfur | % Sulfur Type: Sulfate | pyritic | Organic | % Carbon Recovery |
|---|---|---|---|---|---|---|
| FEEDCOAL | 20.4 | 2.15 | 0.08 | 1.55 | 0.53 | — |
| 1. $MgSiO_3$ | 12.6 | 0.88 | 0.02 | 0.48 | 0.38 | 99 |
| 2. $CaSiO_3$ | 11.6 | 0.83 | 0.02 | 0.32 | 0.57 | 99 |
| 3. $CaAl_2O_4$ | 10.2 | 0.78 | 0.02 | 0.26 | 0.50 | 95 |
| 4. $Al_2O_3$ | 12.2 | 0.89 | 0.02 | 0.34 | 0.53 | 98 |
| 5. $Al_2O_3.Fe_2O_3$ | 12.2 | 0.83 | 0.02 | 0.35 | 0.46 | 97 |
| 6. Zn O | 14.2 | 1.31 | 0.05 | 0.82 | 0.45 | 97 |

What is claimed is:

1. A process for reducing the sulfur and ash content of coal comprising the steps of:
   (1) contacting coal particles containing ash and iron pyrite mineral matter with a promoting amount of at least one conditioning agent capable of modifying or altering the existing surface characteristics of the pyrite under conditions to effectuate alteration or modification of at least a portion of the contained pyritic sulfur, wherein the conditioning agent is an inorganic compound which can hydrolyze in water;
   (2) separating the coal particles from at least a portion of the pyritic sulfur while surface characteristics are altered or modified; and
   (3) recovering coal particles wherein the coal exhibits reduced sulfur and ash content.

2. A process of claim 1 wherein the conditioning agent is an inorganic compound which hydrolyzes in water to form a high surface area inorganic gel.

3. The process of claim 1 wherein the conditioning agent is selected from the group consisting of metal aluminates having the formula $M'_d(AlO_3)_e$ or $M'_f(AlO_2)_g$, wherein M is Fe, Co, Ca, Mg, Ba, Zn, Pb or Mo; and d, e, f and g are whole numbers depending on the ionic valence of M.

4. The process of claim 1 wherein the conditioning agent is selected from the group consisting of aluminasilicates having the formula $Al_2O_3$. x $SiO_2$ wherein x is from about 0.5 to 5.

5. The process of claim 1 wherein the conditioning agent is selected from the group consisting of inorganic cement materials which can bind mineral matter.

6. The process of claim 1 wherein the conditioning agent is selected from the group consisting of aluminum oxide, aluminum hydroxide and mixtures thereof hydrolyzed in water forming an alumina gel.

7. The process of claim 3 wherein the conditioning agent is selected from the group consisting of calcium, magnesium and iron aluminates and mixtures thereof.

8. The process of claim 5 wherein the conditioning agent is selected from the group consisting of portland cement, natural cement, masonry cement, pozzolan cement, calcined limestone and calcined dolomite.

9. The process of claim 8 wherein the cement material is hydrolyzed portland cement.

10. The process of claim 1 wherein contacting coal particles with conditioning agent is at a temperature in the range from about 0° C. to 100° C.

11. The process of claim 10 wherein the temperature is in the range of from about 20° C. to 100° C.

12. The process of claim 1 wherein the coal particles are contacted with conditioning agent for a period of from about 1 minute to 2 hours.

13. The process of claim 12 wherein the coal particles are contacted from a period of from 10 minutes to 1 hour.

14. The process of claim 1 wherein the amount of conditioning agent is from about 0.05% to 15% by weight of mineral matter.

15. The process of claim 1 wherein a dense media is employed in separating the coal particles from pyritic sulfur.

16. The process of claim 1 wherein froth flotation is employed in separating the coal particles from pyritic sulfur.

17. The process of claim 1 wherein the coal is selected from the group consisting of bituminous coal and higher ranked coal.

* * * * *